United States Patent [19]

Karvinen et al.

[11] Patent Number: 4,931,143

[45] Date of Patent: Jun. 5, 1990

[54] PRESS SECTION WITH SEPARATE PRESS NIPS IN A PAPER MACHINE

[75] Inventors: Mikko Karvinen, Vihtavuori; Jorma Laapotti, Palokka, both of Finland

[73] Assignee: Valmet Oy, Finland

[21] Appl. No.: 735,947

[22] Filed: May 20, 1985

[30] Foreign Application Priority Data

May 25, 1984 [FI] Finland ..... 842115

[51] Int. Cl.[5] ..... D21F 3/04

[52] U.S. Cl. ..... 162/360.1; 162/305; 162/306; 162/359

[58] Field of Search ..... 162/205, 206, 305, 306, 162/358, 359, 360.1

[56] References Cited

U.S. PATENT DOCUMENTS

| | | | |
|---|---|---|---|
| 4,201,624 | 5/1980 | Mohr et al. | 162/360.1 |
| 4,287,021 | 9/1981 | Justus et al. | 162/358 |
| 4,483,745 | 11/1984 | Wicks et al. | 162/358 |
| 4,518,460 | 5/1985 | Hauser et al. | 162/358 |
| 4,526,655 | 7/1985 | Karvinen et al. | 162/360.1 |
| 4,561,939 | 12/1985 | Justus | 162/305 |

FOREIGN PATENT DOCUMENTS 2127448 4/1984 United Kingdom .

*Primary Examiner*—Karen M. Hastings
*Attorney, Agent, or Firm*—Steinberg & Raskin

[57] ABSTRACT

A press section of a paper machine includes, in the direction of web run, at least three successive, separate press nips for dewatering a web, the web passing between the nips in a closed draw. The web is dewatered in the first nip through both of its faces. The press section includes at least one upper fabric and lower fabrics, the first fabrics in the direction of web run being water-receiving fabrics arranged such that one of the first fabrics acts as a press fabric in the first nip while the other of the first fabrics acts as a press fabric both in the first as well as in the second nip. Of the second fabrics in the direction of web run, the upper fabric is a water-receiving press fabric while the second lower fabric is a substantially non-water receiving transfer fabric or belt on which the web is transferred from the third press nip to the following drying section as a closed draw. The third separate press nip comprises an extended-nip press, the length of the nip zone thereof being substantially larger than the lengths of the zones of the preceding roll nips. The web runs through the nip zone of the extended-nip press supported on its bottom side by the substantially non-water receiving transfer fabric, the upper water-receiving fabric being pressed against the other side of the web.

7 Claims, 1 Drawing Sheet

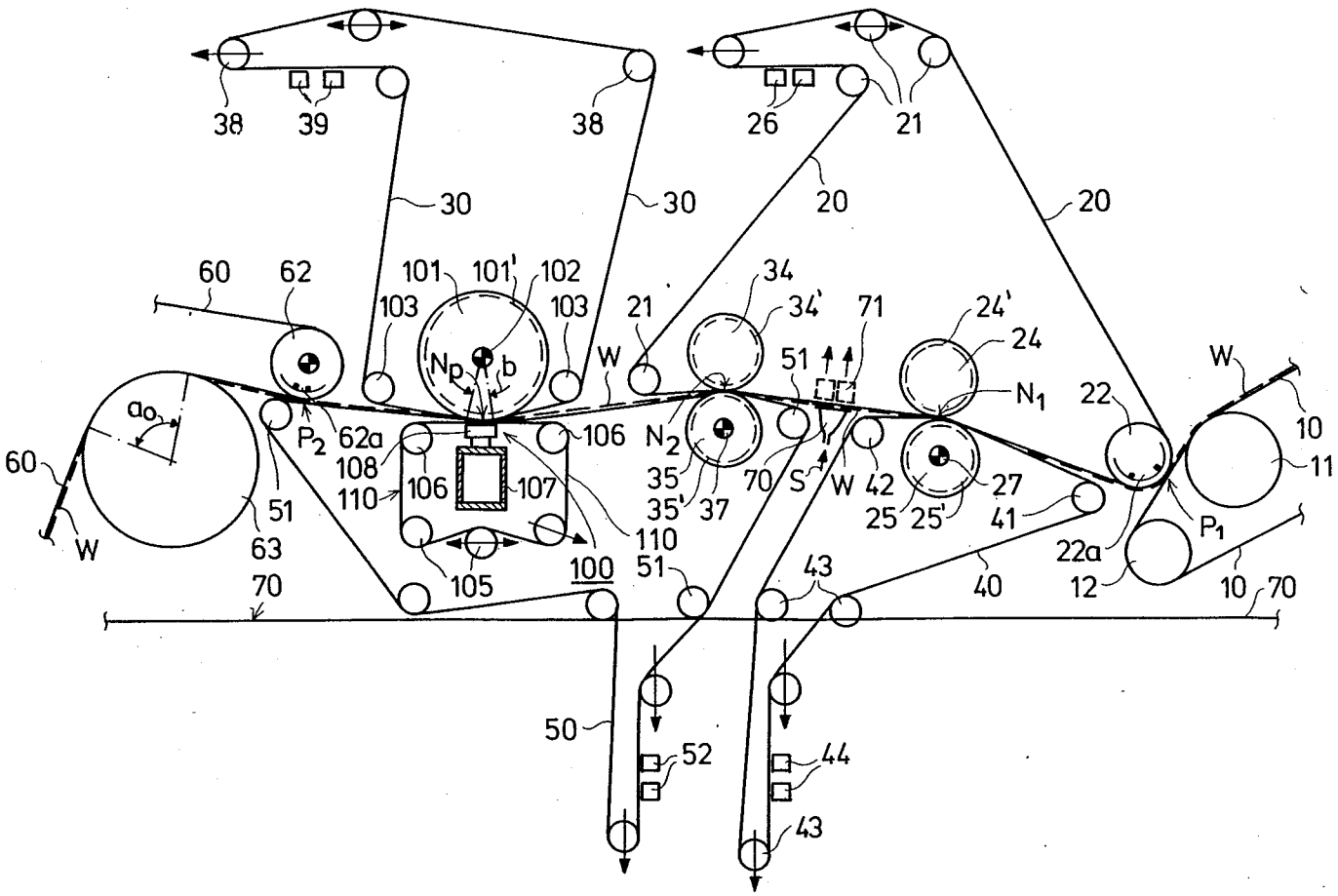
10
11
W
P1
10
70
20
22
22a
12
24'
24
N1
27
41
40
21
25'
25
42
71
W
S
43
44
43
20
26
34'
34
51
70
37
35
35'
N2
110
51
52
30
21
W
106
100
50
38
102
103
107
101'
b
105
101
Np
106
30
103
62a
108
110
39
62
P2
51
63
70
38
60
a0
W
60

PRESS SECTION WITH SEPARATE PRESS NIPS IN A PAPER MACHINE

BACKGROUND OF THE INVENTION

The present invention relates generally to paper making and, more particularly, to the construction of a press section of a paper machine.

The present invention is particularly directed to improvements in press sections which include, in the direction of web passage through the press section, at least three successive, separate dewatering press nips, i.e. press nips formed by their own respective pairs of press rolls, and wherein the web is a closed draw as it travels between the nips. The web is dewatered through both of its faces at least in the first one of the press nips formed between two preferably hollow-faced press rolls. The press section further includes at least one upper fabric and lower fabrics. Of these fabrics, the first fabrics in the direction of web run are water-receiving press fabrics arranged so that one of them acts as a press fabric in the first press nip while the other acts as a press fabric both in the first as well as in the second press nip. Of the second fabrics in the direction of web run, the upper fabric is a water-receiving press fabric while the second lower fabric is a substantially non-water receiving transfer fabric or belt on which the web is transferred after the nip as a closed draw to the drying section which follows the press section.

Dewatering of a paper web by evaporation consumes large amounts of energy and is therefore a costly and uneconomical operation. For this reason, it is usually attempted to remove as much water as possible from the web by mechanical means before the web reaches the drying section of the paper machine. The last stage where water is mechanically removed from the web in a paper machine is the press section where water is removed by pressing the web between rolls. It is well known that water will be more readily removed from the web when the temperature of the water is elevated since the viscosity of the water and the springback coefficient or coefficient of compression elasticity of the web are thereby reduced as is the surface tension.

As the rates of production of paper machines increase, one of the major bottle-necks which limit further increased production rates is the existence of open draws of the web after the press section, either from the press section to the drying section or in the first free spaces in the drying section itself.

The most common conventional arrangement for dewatering fibrous webs, in particular paper and cardboard webs, is one where the web is passed through a press nip formed between two rolls situated in facing relationship to each other. As is well known, one or two press fabrics are used in such dewatering nips, the fabrics carrying the water drained from the web away from the nip and also functioning to carry the web forwardly after the press nip.

A fully closed, compact press section, designated "Sym-Press", available from Valmet Oy of Finland, the assignee of the instant application, is disclosed in Finnish Annoucement Publication No. 50,651. This closed, compact press section utilizes a press-suction roll and a rock or stone roll which may result in certain drawbacks. For example, the perforations formed in the suction rolls reduce the strength of the mantle of the suction rolls thereby requiring the use of special metal alloys in the construction of such rolls as well as requiring that the thickness of the mantles of the suction rolls be relatively great.

Moreover, although it is highly desirable that the press-suction rolls be provided with a variable-crown arrangement, it is not always possible to do so due to the perforations in the mantle of the suction roll and/or since the interior of the press-suction roll is occupied by suction equipment to the extent that the space available for variable-crown equipment is not sufficient.

Prior to the advent of closed and compact press sections, such as the Sym-Press and Sym-Press II press sections of Valmet Oy, open press sections were commonly used wherein each press nip was formed between its own respective pair of press rolls. In this connection, reference is made by way of example to U.S. Pat. Nos. 2,694,348 (E.D. Beachler), 3,268,390 (D.E. Ely), 4,219,383 (P.J. Valkama). One of the reasons why these open press sections are being replaced by fully closed and compact press sections is that a compact press section, e.g. the Sym-Press II press section, requires considerably less space than open press sections. Moreover, the open press sections of the type described in the above mentioned U.S. patents have certain additional drawbacks. For example, the web tends to be rewetted after passing through one or more of the press nips, such rewetting being particularly detrimental between the second and third press nips, especially in the case where thin paper grades are being manufactured.

Attempts have been made to increase the dewatering capacity of a nip press by increasing the nip pressure. However, a certain line pressure is eventually reached beyond which any increase in the nip pressure is no longer desirable since the structure of the web and the press fabrics cannot withstand such increased compression pressures.

The dewatering capacity of a nip press can be increased by lengthening the zone of the roll nips through the use of larger diameter rolls and softer press fabrics. However, a limit is again reached using even this technique.

Accordingly, for these and other reasons, so-called extended-nip presses have recently been proposed. In this connection, reference is made, by way of example, to U.S. Pat. Nos. 3,808,092, 3,808,096, 3,840,429, 3,970,515, 4,210,624, and 4,229,253, to G.B. Pat. Appl. No. 20 57 027, as well to Finnish Patent Application Nos. 82-3500, 83-0995, and 83-1028, the Finnish applications being assigned to the assignee of the instant application.

In Finnish Patent Application No. 82-3187, corresponding to U.S. Application Ser. No. 531,297 filed Sept. 12, 1983, now U.S. Pat. No. 4,526,655, assigned to the assignee of the instant application, a press section is disclosed which constitutes one of the starting points of the present invention. The press section disclosed in said application is an open press section and includes two upper fabrics and two lower fabrics, of which the first fabrics in the direction of web run are water-receiving press fabrics arranged so that one of them acts as a press fabric in the first press nip while the other acts as a press fabric both in the first as well as in the second press nip. Of the second fabrics in the direction of web run, the upper fabric or the lower fabric is a water-receiving press fabric while the other is a substantially non-water receiving transfer fabric on which the web is transferred after the third nip to the drying section following the press section as a closed draw.

Objectives of the press section disclosed in application Ser. No. 531,297, now U.S. Pat. No. 4,526,655, are as follows:

to provide a fully closed draw of the web from the forming wire to the drying fabric, to provide a press section in which press suction rolls are not required, although it is noted that in some cases it is possible or even desirable to use one or more suction rolls for certain purposes, preferably not as press-suction rolls, to provide a press section in which sufficient space is provided between the press nips to allow for the positioning in connection with the press rolls of such equipment as loading devices and doctors, as well as guide and reconditioning devices for the various fabrics, and to allow ease of operation in maintenance of such equipment as well as removal of broke, to provide a press section by means of which a higher dry matter content is obtained or, alternatively, in which it is possible to use pulps of lesser quality relative to that required in conventional paper machines, to provide a press section which avoids or substantially reduces the problems of vibration which exist in conventional press sections and, in particular, in conventional compact press sections, and to provide a press section wherein the same construction can have a lower weight than is the case in the prior art without incurring any risk of additional vibrations.

SUMMARY OF THE INVENTION

In addition to achieving the objects sought in application Ser. No. 531,297, now U.S. Pat. No. 4,526,655, it is an object of the present invention to provide a further improvement in a press section of the type disclosed in said application whereby the operation of the press section can be advantageously combined with the operation of an extended-nip press to obtain the general advantages provided by such construction.

Additionally, another object of the present invention is to provide a new and improved press section comprising separate press nips and which utilizes an extended-nip press in a new and advantageous manner. In this connection, it is difficult to adapt a compact, closed press section, such as the "Sym-Press" press section, with an extended-nip press since the latter cannot be arranged against the central stone or rock roll of such a press section.

A further object of the present invention is to provide a new and improved press section with separate press nips wherein a variable-crown steel mantle roll can be advantageously utilized as a counter-roll of an extended-nip press so that the use of a rock or stone roll can be completely eliminated.

It is a particular object of the present invention to provide a new and improved press section with separate press nips in which higher dry solid content can be obtained for the web than by a press section constructed in accordance with Finnish Application No. 83-1028.

A still further object is to provide a new and improved press section having separate press nips including an extended-nip press and wherein a web is obtained having improved strength due to the extended-nip press which is of particular importance in the production of board material.

Yet another object of the present invention is to provide a new and improved press section having separate press nips by which paper or board web having improved symmetry is obtained.

In accordance with the present invention, these and other objects are obtained by providing a press section of the type disclosed in said application Ser. No. 531,297, now U.S. Pat. No. 4,526,655, wherein the third separate press nip in the press section is a so-called extended-nip press, the length of the nip zone of which is substantially larger than the lengths of the zones of the preceding roll nips, and wherein the extended-nip press is arranged so that the web passes through the nip zone of the extended-nip press with its bottom side supported by the substantially non-water receiving transfer fabric while the opposite side of the web is pressed by the water-receiving press fabric.

A press section in accordance with the invention provides a fully closed draw of the web thereby reducing the risk of web breaks and which enables the paper machine to be operated at higher running speeds. Energy economy is obtained by reason of the increased dry solid content of a web produced by a press section in accordance with the invention since the specific consumption of energy attributed to dewatering by means of compression is considerably less than the energy required for dewatering by means of evaporation. The advantages provided by a press section in accordance with the invention can also be utilized in the form of increased production since the press section provides the capability of increased running speed.

DESCRIPTION OF THE DRAWINGS

A more complete appreciation of the present invention and many of the attendant advantages thereof will be readily understood by reference to the following detailed description when considered in connection with the accompanying drawing in which the sole FIGURE is a schematic elevation view of a press section in accordance with the invention.

DETAILED DESCRIPTION OF THE PREFERRED EMBODIMENTS

Referring now to the drawing, the web W is formed on a wire 10, which is either a fourdrinier wire or the carrying wire of a twin wire former. The web W is detached from the wire 10 at the detachment line $P_1$ located on a downwardly slanting run of the wire 10 between a suction roll 11 and a driveroll 12, within the suction zone 22*a* of a pick-up roll 22. The web is transferred onto the bottom surface of a first upper fabric 20 which functions both as a water-receiving press fabric as well as a pick-up fabric. The guiderolls of first upper fabric 20 are designated by reference numeral 21 and fabric reconditioning devices are designated by numeral 26.

The web is carried on the lower surface of fabric 20 into the first press nip $N_1$ formed between press rolls 24 and 25 which have hollow faces 24' and 25' respectively formed, for example, of radial grooves, blind-drilled holes or the like or most preferably by a spiral-grooved coating band wound around the roll. The first press nip $N_1$ is provided with two press fabrics namely the first upper fabric 20 and a first lower fabric 40, the latter also being a water-receiving fabric. The guide rolls of fabric 40 are designated by numerals 41, 42 and 43, and a fabric reconditioning device is designated by numeral 44. One or both of the press rolls 24 and 25 may be variable-crown rolls, if necessary. The hollow face 24', 25' of the press roll 24, 25 may be hard or soft and the lower press roll 25 is preferably provided with a drive unit 27.

One of the press rolls 24 and 25 may be a press-suction roll although the use of such a roll involves the drawbacks mentioned above. Dewatering takes place through both faces of the web W in the first press nip $N_1$, i.e., both into the upper fabric 20 and into the lower fabric 40. This at least partly guarantees a symmetric and yet gentle initial dewatering of the web.

Following the first press nip $N_1$ in the direction of web run, a second separate nip $N_2$ is provided which is formed between two press rolls 34 and 35. In the illustrated embodiment, the press rolls 34 and 35 have hollow faces 34', 35', although such provision is not always necessary. The web W is carried into the second press nip $N_2$ on the bottom face of the first upper fabric 20 as a closed draw.

That the web W will follow the upper fabric 20 and not the lower fabric 40 after the first press nip $N_1$ is insured, for example, by means of the arrangement discussed in detail in application Ser. No. 531,297, now U.S. Pat. No. 4,526,655, the subject matter of which is hereby incorporated by reference.

The lower fabric 50 in the second press nip $N_2$ is a transfer fabric which is a relatively impervious, substantially non-water receiving fabric relative to conventional press fabrics. Thus, the dewatering of the web in the second nip $N_2$ takes place mainly upwardly towards the first fabric 20. The lower press roll 35 in press nip $N_2$ may be a smooth face roll although it is preferable that it be provided with a hollow face 35' even though there is substantially no removal of water from the web W that takes place towards the second lower or transfer fabric 50. Due to the surface properties of transfer fabric 50 and the arrangements discussed in application Ser. No. 531,297, now U.S. Pat. No. 4,526,655, the web W follows the transfer fabric 50 after the second press nip $N_2$ which carries the web W into the third separate dewatering press nip $N_p$ which, in accordance with the invention, comprises a nip of an extended-nip press. The guide rolls of the transfer fabric or belt 50 are designated by numeral 51 and the fabric reconditioning devices by numeral 52.

An important feature of the present invention is in the provision of an extended-nip press 100 separate from the first and second press nips $N_1$ and $N_2$. In the extended nip $N_p$, the paper web W is pressed against a counter-roll 101 of means of a press shoe 108. Due to the high loads in the extended nip $N_p$, the roll 101 is preferably a variable crown roll. However, crown variation is not necessarily required because the relatively narrow shoe will tend to follow the deflection of roll 101. The counter-roll 101 is provided with a hollow face 101' and a drive unit, designated 102.

The press zone of the extended nip $N_p$ extends on the roll 101 over a central angle b. The web W passes through the press zone b situated between the transfer fabric 50 and an upper press felt 30 guided by guide rolls 103 which are proximate to roll 101 and additional guide rolls 38. Devices for reconditioning the second upper felt 30 are designated by numeral 39.

The web W is introduced into the press zone b on the upper face of the transfer fabric 50 and follows the transfer fabric 50 after the nip $N_p$, the web W being detached from the upper felt 30 mainly by the effect of the surface properties of the fabric 50 or by the effect of other conventional devices. It is desirable that the web W be detached from the upper felt 30 as soon as possible after passing through the nip $N_p$ in order to prevent rewetting. Since the transfer fabric 50 is substantially non-water receiving, it cannot be a source of rewetting.

The compression pressure of the shoe 108 is applied to the web W through the transfer fabric 50 by means of a dense compression belt 110 formed, for example, of dense plastic, rubber or metallic material. The belt 110 is guided by guide rolls 105 and 106 and the press shoe 108 is supported by a beam 107. The beam 107 may be stationary and possibly provided with a variable-crown. The compression pressure in the nip $N_p$ is produced by means of conventional loading devices (not shown) applied to the shoe 108.

The press shoe 108 may be a so-called hydrodynamic shoe or a so-called hydrostatic shoe, or may comprise a combination of both.

Lubrication oil or the like is introduced onto the impervious belt 110 at the inlet side of the extended nip $N_p$. Accordingly, the impervious belt 110 should be located precisely beneath the web W as the latter runs through the nip $N_p$ in order to prevent splashing of lubricant onto the web W which would spoil the web.

The basic construction of extended-nip presses, such as the press 100, are generally known. However, reference is made to the extended-nip press disclosed in application Ser. No. 590,951 filed Mar. 19, 1984 and assigned to the same assignee as the instant application, wherein an extended-nip press is disclosed, the details of which may be applied in connection with the extended-nip press 100. The disclosure of application Ser. No. 590,951 is incorporated by reference. It is noted, however, that the extended-nip press 100 utilized in the press section of the invention differs from conventional extended-nip presses in that the web W runs through the extended-nip $N_p$ between an upper water-receiving fabric and a lower fabric 50 which is substantially non-water receiving for reasons discussed above and which will become clearer below.

Due to the high load that exists in the extended-nip $N_p$, the diameter of the counter-roll 101 is generally larger than the diameters of the other press rolls of the press section. In each of the first and second nips $N_1$ and $N_2$, one of the press rolls is preferably a variable-crown roll having a diameter in the range of between about 700 to 900 mm while the other press roll is a rigid steel roll having a diameter in the range of between about 1,000 to 1,400 mm. The counter-roll 101 of the extended-nip $N_p$ is either a variable-crown roll having a diameter in the range of between about 1,100 to 1,400 mm or a rigid roll having a diameter in the range of between about 1,500 to 1,800 mm. The width of the press shoe 108, i.e., the width of the nip zone b, is generally of an order of about 15 to 25 cm, and preferably about 20 cm.

After passing through the extended-nip $N_p$, the web W is carried on transfer fabric 50 onto a transfer suction roll 62 over the suction zone **62*a* of which the drying wire 60 of the drying section passes. The web W is transferred at transfer line $P_2$ onto the drying wire 60 by the effect of the suction zone 62*a* whereupon the web W adheres to the drying wire 60 and passes over the first drying cylinder 63, or so-called baby cylinder, in the drying section over a sector $a_0$. The web W continues its run supported on the drying wire 60**, preferably as a so-called single-wire draw, at least in the initial part of the drying section.

A steam box 70 is situated between the first and second nips $N_1$ and $N_2$ and supplies steam S against the web W.

A suction box 71 may be placed on the opposite of the web, i.e., opposite the first upper fabric 20. A steam box (not shown) may also be provided between the second and third nips $N_2$ and $N_p$. The function of the steam box 70 or boxes where applicable, is to increase the dry solid content of the web in that after the application of steam from the steam box 70, more water can be removed from the web due to the reduction in viscosity of the water on the one hand and due to the reduction in the springback coefficient on the other hand, both of which phenomena are a result of the higher temperature at which compression takes place.

It is clear from the foregoing that a web passes in a fully closed draw through a press section in accordance with the invention between the points $P_1$ and $P_2$. In other words, the web W is at all times supported on the face of either press fabric 20, 40 or of the transfer fabric 50 and there are no unsupported or open passages of the web W. This feature increases the reliability of operation of the press section by reducing the risk of web breaks.

In a press section in accordance with the invention, dewatering of the web takes place in both directions in the first press nip $N_1$, i.e., through both faces of the web W. This action tends to improve the symmetry of the web W. The dewatering of the web takes place mainly upwardly in the second and third press nips $N_2$ and $N_p$ since the transfer fabric 50 which runs through the nips $N_2$ and $N_p$ is a substantially non-water receiving fabric.

An important feature of the invention, in addition to the provision of the extended nip $N_p$ of the extended nip press 100, is the use of the substantially non-water receiving transfer fabric 50 which also transfers the web W as a closed draw to the drying section. The property that the transfer fabric 50 is substantially non-water receiving generally implies, although not necessarily, that the transfer fabric 50 is relatively impervious. The transfer fabric 50 is, for example, a fabric produced by impregnating an ordinary press felt with an appropriate plastic material. In some applications, the transfer fabric 50 may be to some extent pervious and/or water-receiving. In the present invention, the term "transfer fabric" means a fabric or band in general whose permeability (perviousness to air) is within the range of 0 to 2.0 $m^3/m^2\times$ min. when the difference in pressure $\Delta p=10$ mm $H_20$ (water column). In comparison, the perviousness to air of a normal new press felt is generally within the range of between about 10 to 30 $m^3/m^2\times$min. The perviousness to air of a normal used press felt is generally in the range of about $5m^3/m^2\times$min. at the same pressure difference. Under the circumstances, and in view of the fact that the transfer fabric 50 is substantially non-water receiving, it is also advantageous that the transfer fabric be relatively dense and impervious so that its permeability is considerably lower than the permeability of ordinary water-receiving press felts.

The surface properties of the transfer fabric 50 also influence the surface properties of the web W being produced as well as influencing which particular fabric the web follows after each nip. The transfer fabric 50 may be water-receiving at least to some extent, especially where thicker paper qualities are being produced. As a general rule, the thicker the paper qualities that are being prepared, the denser the transfer fabric 50 must be.

It is possible to use the transfer fabric or band that carries the web to the drying section in lieu of the drying wire 60 to carry the web onto a roll face or fabric therein so that the web W continues its run in the drying section. In some cases it is also possible to use open draws in the drying section since the web W will obtain a relatively high dry matter content in the press section so that the web W will be relatively strong.

In general, the line pressures in the various nips of a press section in accordance with the invention may be within the following ranges:

$P_{N1}=50$ to 100 kN/m, $P_{N2}=70$ to 150 kN/m, $P_{Np}=500$ to 1000 kN/m.

One suitable combination of line pressures in the nips $N_1$, $N_2$ and $N_p$ is $P_{N1}=70$kN/m, $P_{N2}=100$kN/m, and $P_{Np}=$ 800kN/m. Higher line pressures can be used in the press section in accordance with the invention than, for example, in the Sym-Press press compact press section since all of the nips are provided with two fabrics so that in addition to the extended nip $N_p$, the roll nips $N_1$ and $N_2$ can have nip zones which are relatively long. Moreover, the press rolls can have solid mantles, including hollow-faced and in certain cases even smooth mantles, or can be formed of cast iron. Such rolls are more durable and less expensive than the suction rolls having perforated mantles or smooth-faced rock or stone rolls.

The closed draw of the web W through the entire press section and to the drying section provided by a press section in accordance with the invention is also advantageous in that even if a drying wire 60 or corresponding transfer fabric is used which has a seam, such seam will not leave a mark in the web because the transfer suction roll 62 acts on a yielding straight run of the transfer fabric 50 and not against a hard roll face.

A press section in accordance with the invention is also advantageous in that the web W runs as a fully closed draw through all of the press nips $N_1$, $N_2$ and $N_p$ substantially horizontally so that the press nips are substantially in the same horizontal plane and spaced a distance from each other which is sufficient so that guide rolls for the various fabrics and other equipment, such as steam boxes, can be easily positioned.

With regard to the frame construction of the press section, the floor level of the paper machine hall is designated by numeral 75 and reference is made to application Ser. No. 531,297, now U.S. Pat. No. 4,526,655, which illustrates a typical frame construction.

Obviously, numerous modifications and variations of the present invention are possible in the light of the above teachings. It is therefore to be understood that within scope of the claims appended hereto, the invention may be practiced otherwise than as specifically disclosed herein.

What is claimed is:

1. In a press section of a paper machine including, in the direction of run of a web through the press section, at least first, second and third successive separate press nips having respective nip zones for removing water from the web, the web running between said nips in a closed draw, and wherein dewatering takes place through both faces of the web in at least said first press nip, said first press nip being formed by two hollow-faced rolls, said second press nip being formed by a separate pair of press rolls, said press section further including upper and lower fabrics, and wherein first upper and lower fabrics in the direction of web run are water-receiving press fabrics, one of said first upper and lower fabrics constituting a press fabric only in said first press nip and the other of said first upper and lower fabrics constituting a press fabric both in said first press nip and in said second press nip, and where second upper and lower fabrics in the direction of web run include a second upper water-receiving press fabric and a second lower substantially non-water receiving transfer fabric or belt on which the web is transferred from said third press nip to a drying section of the paper machine, the improvement comprising:

said third press nip is formed by an extended-nip press, said nip zone of said third press nip being substantially longer than the lengths of said nip zones of said first and second press nips, and wherein said second lower substantially non-water receiving transfer fabric supports a bottom side of the web and said second upper water-receiving press fabric is pressed against a top side of the web as the web passes through said third extended-nip press, said extended-nip press further comprising an upper hollow-faced roll acting on said second upper water-receiving press fabric, a looped impervious belt, a lower press shoe situated within the loop of said impervious belt, said impervious belt transmitting pressure directed by said press shoe at said nip zone of said third press nip through said substantially non-water receiving fabric, and means for driving said upper press roll, and wherein said transfer fabric constitutes means for transferring the web after said third nip as a closed draw to the drying section of the paper machine.

2. The combination of claim 1 wherein one of said first upper and lower fabrics acts as a pick-up fabric onto which the web is transferred from a forming wire of the paper machine.

3. The combination of claim 1 wherein the length of said nip zone of said third extended-nip press in the direction of web run is in the range of between about 15 to 25 cm.

4. The combination of claim 3 wherein the length of said nip zone of said third extended-nip press in the direction of web run is about 20 cm.

5. The combination of claim 1 further including a transfer suction roll following said third press nip in the direction of web run, said transfer suction roll having a suction zone, a drying wire passing over said transfer suction roll and a first cylinder of a drying section of the paper machine, and guide roll means for guiding said web carrying substantially non-water receiving transfer fabric over a substantially straight run into proximity with said suction zone of the transfer suction roll, whereby the web is transferred from said transfer fabric onto said drying wire.

6. The combination of claim 1 wherein said upper press roll acting on said second upper water-receiving press fabric in said extended-nip press comprises an adjustable- or variable-crown roll.

7. The combination of claim 1 wherein said first, second and third press nips are substantially situated in a common horizontal plane.

* * * * *